US007726398B2

(12) United States Patent
Collins et al.

(10) Patent No.: US 7,726,398 B2
(45) Date of Patent: Jun. 1, 2010

(54) WATER FLOODING METHOD

(75) Inventors: Ian Ralph Collins, Sunbury-on-Thames (GB); Kang Li, Cheam (GB); Andrew Guy Livingston, Knebworth (GB); John Dale Williams, Buckinghamshire (GB)

(73) Assignee: BP Exploration Operating Company Limited, Middlesex (GB)

( * ) Notice: Subject to any disclaimer, the term of this patent is extended or adjusted under 35 U.S.C. 154(b) by 125 days.

(21) Appl. No.: 11/921,569

(22) PCT Filed: Jun. 15, 2006

(86) PCT No.: PCT/GB2006/002192

§ 371 (c)(1),
(2), (4) Date: Dec. 5, 2007

(87) PCT Pub. No.: WO2006/134367

PCT Pub. Date: Dec. 21, 2006

(65) Prior Publication Data

US 2009/0050320 A1 Feb. 26, 2009

(30) Foreign Application Priority Data

Jun. 16, 2005 (GB) ..... 0512248.6

(51) Int. Cl.
*E21B 43/20* (2006.01)
*E21B 43/40* (2006.01)

(52) U.S. Cl. ..... 166/275; 166/266; 166/267; 166/372

(58) Field of Classification Search ..... None
See application file for complete search history.

(56) References Cited

U.S. PATENT DOCUMENTS

| | | | | |
|---|---|---|---|---|
| 3,283,813 | A | 11/1966 | Brownscombe et al. | |
| 4,723,603 | A | 2/1988 | Plummer et al. | |
| 2001/0050252 | A1 | 12/2001 | Mickols | |
| 2003/0230535 | A1 | 12/2003 | Affeld et al. | |
| 2008/0169098 | A1* | 7/2008 | Christopher et al. | 166/275 |

FOREIGN PATENT DOCUMENTS

| | | |
|---|---|---|
| EP | 0 968 755 | 1/2000 |
| GB | 1 250 877 | 8/1978 |
| JP | 2001/252542 | 9/2001 |
| WO | WO 94/12267 | 6/1994 |
| WO | WO 99/06323 | 2/1999 |
| WO | 02/12675 | 2/2002 |
| WO | 03/102346 | 12/2003 |
| WO | 2005/119007 | 12/2005 |
| WO | 2006/008439 | 1/2006 |

OTHER PUBLICATIONS

McGuire, P.L., et al; "Low Salinity Oil Recovery: An Exciting New EOR Opportunity for Alaska's North Slope"; SPE 93903; *SPE Western Regional Meeting*, pp. 1-15 (2005).
Jadhunandan, P.P. et al; "Effect of Wettability on Waterflood Recovery for Crude-Oil/Brine/Rock Systems"; *SPE Reservoir Engineering*; pp. 40-46 (Feb. 1995).
Zhou, X., et al; "Interrelationship of Wettability, Initial Water Saturation, Aging Time, and Oil Recovery by Spontaneous Imbibition and Waterflooding"; SPE/DOS 35436; 15 pgs (Apr. 1996).
Buckley, J.S., et al; "Wetting Alteration by Brine and Crude Oil: From Contact Angles to Cores"; SPE 30765; *SPE Journal*; pp. 341-350 (Sep. 1996).
Xie, X., et al; "Crude Oil/Brine contact Angles on Qurtz Glass"; SCO Core Analy Int Symp (Calgary Canada) Proc. Paper No. SCA 9712; pp. 1-10 (1997).
Yildiz, H.O., et al; "Effect of Brine Composition on Wettability and Oil Recovery of a Prudhoe Bay Crude Oil"; *Journal of Canadian Petroleum Technology*; vol. 38, No. 1; pp. 26-31 (Jan. 1999).
McGuire et al., "Low Salinity Oil Recovery: An Exciting New EOR Opportunity for Alaska's North Slope", *SPE 93903*, Mar. 2005, pp. 1-15 XP002393783 (Abstract).
Webb et al., "Low Salinity Oil Recovery—Log-Inject-Log", *SPE 89379*, Apr. 2004, pp. 1-7, XP002336390.
Tang et al., "Influence of Brine Composition and Fines Migration on Crude Oil/Brine/Rock Interactions and Oil Recovery", *Journal of Petroleum Science and Engineering*, vol. 24, Dec. 1999, pp. 99-111, XP002336391 (Abstract).

* cited by examiner

*Primary Examiner*—Zakiya W. Bates
(74) *Attorney, Agent, or Firm*—Nixon & Vanderhye

(57) ABSTRACT

A method of recovering hydrocarbons from a porous subterranean hydrocarbon-bearing formation by: (a) reducing the salinity of a saline source water by reverse osmosis using a membrane having a first surface and a second surface by (i) feeding the saline source water to the first surface of the membrane, and (ii) removing treated water of reduced salinity from the second surface of the membrane; and (b) injecting the treated water into the formation; wherein the membrane is selectively permeable to water over dissolved solids such that when (i) the saline source water has a total dissolved solids content of at least 17,500 ppm, and (ii) the applied pressure across the membrane is greater than the osmotic pressure across the membrane and lies within the range 45 to 90 bar (4.5 to 9.0 M Pa), the total dissolved solids content of the treated water is in the range 500 to 5000 ppm.

7 Claims, 1 Drawing Sheet

WATER FLOODING METHOD

Figure 1:
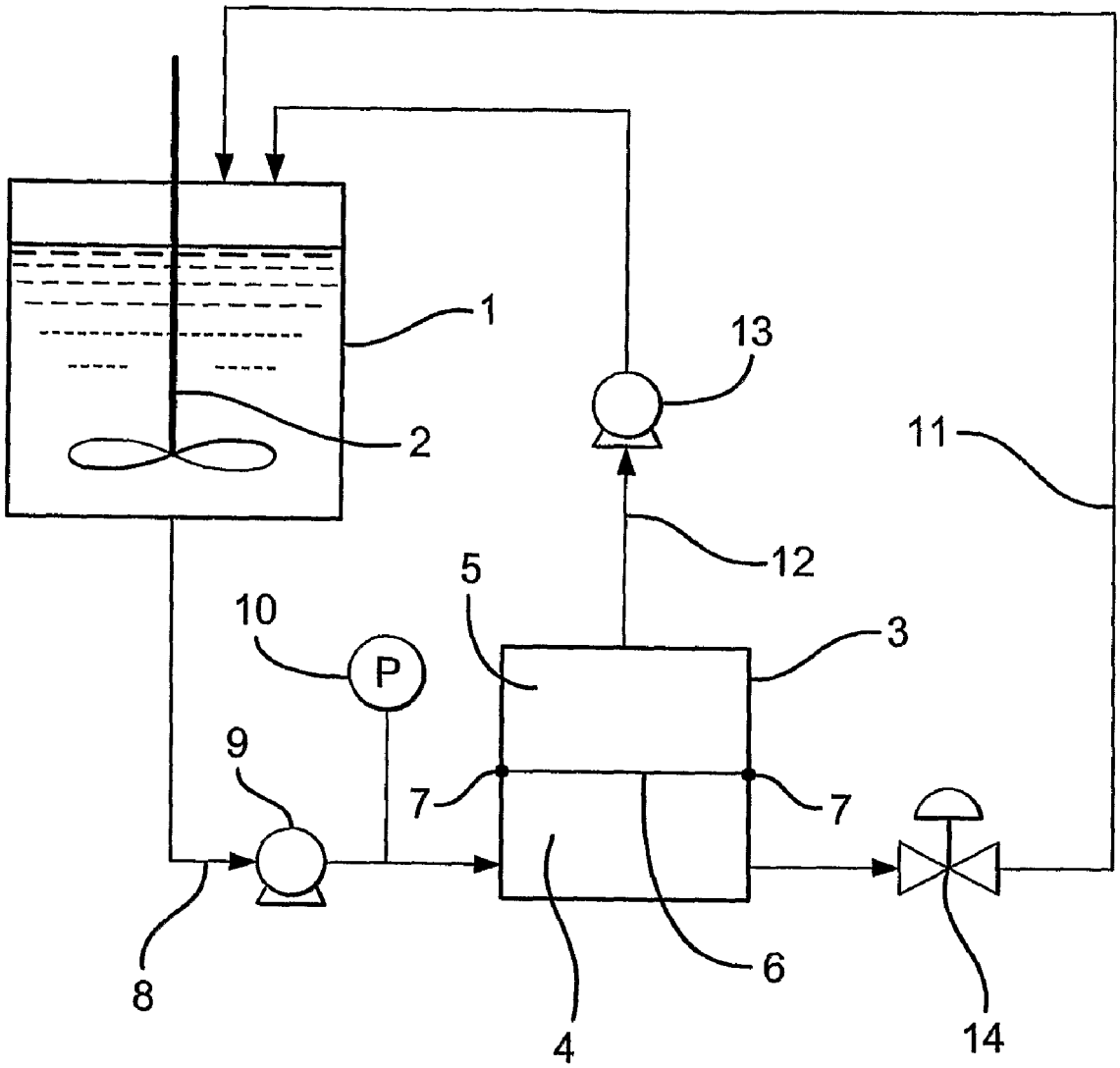

This application is the U.S. national phase of International Application No. PCT/GB2006/002192 filed 15 Jun. 2006 which designated the U.S. and claims priority to Great Britain Application No. 0512248.6 filed 16 Jun. 2005, the entire contents of each of which are hereby incorporated by reference.

The present invention relates to a method of recovering hydrocarbons from a porous subterranean hydrocarbon-bearing formation by reducing the salinity of a source water having an initial relatively high salinity and injecting the treated water into the formation.

It has long been known that only a portion of the oil can be recovered from a permeable oil-bearing subterranean formation as a result of the natural pressure of the reservoir. So-called secondary recovery techniques are used to force the oil out of the reservoir. The simplest method of forcing the oil out of the reservoir rock is by direct replacement with another fluid, usually water or gas.

Water-flooding is one of the most successful and extensively used secondary recovery methods. Water is injected, under pressure, into reservoir rocks via injection wells, driving the oil through the rock towards production wells. The water used in water-flooding is generally saline water from a natural source such as seawater (hereinafter "source water"). It has generally been considered desirable to use water for the secondary recovery operation that is free from suspended particles or any chemical impurities that might cause a partial or complete blockage of the pores of the reservoir rock. Consequently, a source water having an ionic concentration similar to that of the connate water associated with the oil bearing stratum was often considered to be the most suitable as it would be less likely to have a deleterious effect on the reservoir rock. However, it has not always been possible to readily supply water with the required ionic concentration from seawater.

UK Patent 1520877 discloses a method for the secondary recovery of oil by water-flooding a permeable oil bearing stratum, having connate water associated therewith, in which method the source water for injection into the stratum is treated in a reverse osmosis desalination plant to adjust the ionic composition and/or increase or decrease the ionic concentration of the water in relation to the nature of the stratum and the connate water. In the specific example, tests were made on samples of the reservoir rock and the connate water to determine the required ionic composition and concentration of the treated water to be used for injection into the injection well. Raw seawater containing approximately 35,000 ppm NaCl was fed to a reverse osmosis apparatus to produce a product water concentrate having the required ionic composition of approximately 100,000 ppm NaCl. Thus, the ionic concentration of the source water was adjusted using reverse osmosis so as to be compatible with the connate water.

In addition, the injected water needs to be compatible with the formation rock and connate water so that, for example, they do not on contact initiate undesirable precipitation of one or more of barium sulfate, barium carbonate, strontium sulfate, calcium sulfate and calcium carbonate, forming scale on surfaces.

U.S. Pat. No. 4,723,603 discloses a process for reducing or preventing plugging in fluid passageways of hydrocarbon-bearing formations and in production wells, which is caused by the accumulation of insoluble salt precipitates therein. The process removes most or all of the precursor ions of the insoluble salt precipitates from an injection water at the surface before the water is injected into the formation. The precursor ions of the insoluble salt precipitates are removed by means of a reverse osmosis membrane. The membrane is preferably one that selectively prevents the precipitate precursor ions from passing across it from the feed into the injection water while at the same time allowing the water solvent and harmless ions such as $Na^+$ and $Cl^-$ to pass across it. In the specific example disclosed in U.S. Pat. No. 4,723,603, the total dissolved solids content of the water is reduced by only about 20% to 23615 mg/l (23615 ppm) with 91.1% $Na^+$ ions, and 92.0% $Cl^-$ ions being retained in the treated water and 96.9% of $SO_4^{2-}$ ions being rejected by the membrane.

The factors that control crude oil/brine/rock interactions and their effect on wettability and oil recovery involve complex and sometimes competing mechanisms. It has been reported that oil recovery can be dependent on brine concentration. In particular, it has been shown that the use of a lower salinity brine during water-flooding can increase oil recovery (see, for example: (a) MANSURE, Arthur J; WHITNEY, Earl M; ROBERTSON, Eric P; MORROW, Norman R and POPE, Gary A, "Labs Spin Out Oil Field Technologies", American Oil & Gas Reporter, Vol. 41, No. 7, July 1998, pages 105-108; (b) YILDIZ, Hasan O; MORROW, Norman R, "Effect of Brine Composition on Recovery of Moutray Crude Oil by Waterflooding", Journal of Petroleum Science and Engineering 14 (1996), pages 159-168; (c) MORROW, Norman R; TANG, Guo-quing; VALAT, Marc and XIE, Xina, "Prospects of improved oil recovery related to wettability and brine composition", Journal of Petroleum Science and Engineering 20 (1998) pages 267-276), (d) TANG, G. and MORROW, N. R., "Oil Recovery by Waterflooding and Imbibition-Invading Brine Cation and Salinity," (SCA9911) "Proceedings of the 1999 International Symposium of the Society of Core Analysts," held in Golden, Colo., 1-4 Aug. 1999 and (e) TANG, G and MORROW, N. R., "Injection of Dilute Brine and Crude Oil/Brine/Rock Interactions", (AGU) Geophysical Monograph Series Vol. 129, Environmental Mechanics: Water, Mass and Energy Transfer in the Biosphere, ed. Raats and Warrick (July 2002) pages 171 to 179. The aqueous phases used in the latter work were synthetic reservoir brines and dilutions of these brines with salinity ranging from 0.01 to 2% by weight.

It has been found that injection water for use in water-flooding having a total dissolved solids concentration of from about 500 to about 5000 ppm increases oil recovery compared with the use of injection water of a higher total dissolved solids concentration. Commercially available reverse osmosis technology for desalinating water has been deployed primarily for the production of very low salinity water such as potable water. The known desalination processes using commercially available equipment would tend to overtreat the saline source water, with a consequent cost penalty. Overtreating a portion of the injection water and then blending it with untreated feed water may leave residual levels of sulfate ions such that there is a risk of unacceptable mineral scale precipitation when the resulting water blend is injected into the formation, unless additional purification steps are employed. Furthermore, the sulfate ions in such a water blend may act as a nutrient source for sulfate reducing bacteria (SRB) that may be present in the formation, resulting in the production of hydrogen sulfide and souring of the formation.

Strictly speaking, a reverse osmosis membrane is relatively impermeable to all ions, including sodium and chlorine ions. Therefore, reverse osmosis membranes are widely used for the desalination of brackish water. Brackish water is considerably less saline than seawater and includes (1) water that contains dissolved minerals in amounts that exceed normally acceptable standards for municipal, domestic, and irrigation uses and (2) marine or estuarine waters with mixohaline salinity (500-17,000 ppm total dissolved solids (TDS) due to ocean salts). However, the commercially available membrane modules for desalinating brackish water are designed to operate at pressures that would be insufficient to achieve the desalination of a high salinity source water such as seawater. In the known processes for desalinating brackish water, the reverse osmosis membranes are operated in such a manner that the product water has a very low total dissolved solids content.

Desalination using reverse osmosis is largely governed by the properties of the membrane used in the process. These properties depend on the intrinsic properties of the membrane material, and also the physical structure of the membrane. Properties of an ideal reverse osmosis membrane include: (1) resistance to chemical and microbial attack; (2) mechanical and structural stability over long operating periods and (3) the desired separation characteristics for the reverse osmosis system (the "selectivity" of the membrane).

It has now been found that reverse osmosis may be employed for reducing the salinity of a source water having a total dissolved solids content of at least 17,500 ppm to give a treated water having the desired total dissolved solids content of 500 to 5000 ppm for use in water flooding operations.

Thus, the present invention relates to a method of recovering hydrocarbons from a porous subterranean hydrocarbon-bearing formation comprising:

(a) reducing the salinity of a saline source water by reverse osmosis using a membrane having a first surface and a second surface by (i) feeding the saline source water to the first surface of the membrane, and (ii) removing treated water of reduced salinity from the second surface of the membrane; and (b) injecting the treated water into the formation; wherein the membrane is selectively permeable to water over dissolved solids such that when (i) the saline source water has a total dissolved solids content of at least 17,500 ppm and (ii) the applied pressure across the membrane is greater than the osmotic pressure across the membrane and lies within the range 45 to 90 bar (4.5 to 9.0 MPa), the total dissolved solids content of the treated water is in the range 500 to 5000 ppm.

The source water can be seawater or a produced water. By produced water is meant water produced from a subterranean formation e.g. formation water and breakthrough seawater. The source water preferably has a total dissolved solids content (total salinity) greater than 20,000 ppm. The total salinity of the source water may be greater than 30,000 ppm, and may be for example, 20,000 to 45,000 ppm, preferably, 25,000 to 35,000 or 39,000 ppm.

Membranes suitable for use in the method of the present invention were characterised using the Sourirajan Solution Diffusion model, discussed below, to describe performance in the pressure range 45 to 90 bar (4.5 to 9.0 MPa) and were determined to have:

a) a proportionality constant (A) of from $0.01\times10^{-6}$ to $10\times10^{-6}$ kmol $m^{-2}s^{-1}kPa^{-1}$, b) a solute transport parameter ($D_{AM}K_A/\delta$) of from $0.5\times10^{-7}$ to $50\times10^{-7}$ $ms^{-1}$, and c) a diffusivity of solute per unit length of the boundary layer (k) of from $0.1\times10^{-5}$ to $10\times10^{-5}$ $ms^{-1}$.

Thus, the Sourirajan Solution Diffusion model allows parameters (a), (b) and (c) above to be readily determined by a person skilled in the art from known formulae. Specifically, the following transport equations can be readily derived by a person skilled in the art from known transport phenomena equations, such as Fick's Law and are disclosed, for example, in the book *Reverse Osmosis/Ultrafiltration Principles*, Sourirajan, S., and Matsuura, T, National Research Council of Canada, Ottawa, Canada (1985):

$$J_B = A\times(p_h - p_{(X_{A3})} - (\pi_{(X_{A2})} - \pi_{(X_{A3})})) \quad (1)$$

$$J_B = \frac{D_{AM}K_A}{\delta}\times\left(\frac{1-X_{A3}}{X_{A3}}\right)(C_2X_{A2} - C_3X_{A3}) \quad (2)$$

$$J_B = kC_1(1-X_{A3})\ln\left(\frac{X_{A2}-X_{A3}}{X_{A1}-X_{A3}}\right) \quad (3)$$

where:

$J_B$ is the solvent flux through the membrane (kmol $m^{-2}h^{-1}$)

A is the proportionality constant (kmol $m^{-2}$ $s^{-1}$ $kPa^{-1}$)

$P_h$ is the pressure at feed side (kPa)

$P_{(XA3)}$ is the pressure at permeate side (kPa)

$\pi_{(XA2)}$ is the osmotic pressure at feed side (kPa)

$\pi_{(XA3)}$ is the osmotic pressure at permeate side (kPa)

$D_{AM}$ is the diffusivity of solute in the membrane phase ($m^2s^{-1}$), $K_A$ is the equilibrium constant δ is the thickness of the membrane separating layer (m)

$C_1$ is the total molar concentration of solute in bulk feed liquid ($kmolm^{-3}$)

$X_{A1}$ is the mole fraction of solute in bulk feed liquid $C_2$ is the total molar concentration of solute in feed boundary layer/membrane interface ($kmolm^{-3}$)

$X_{A2}$ is the mole fraction of solute in feed boundary layer/membrane interface $C_3$ is the total molar concentration of solute in permeate side ($kmolm^{-3}$)

$X_{A3}$ is the mole fraction of solute in permeate side k is the diffusivity of solute per unit thickness of the boundary layer on the feed side of the membrane (m $s^{-1}$) and $k=D_{AM}/l$ where l is the thickness of the boundary layer.

For any particular reverse osmosis membrane, the person skilled in the art can readily determine the pure water permeation rate (PWR), permeate rate (PR) and salt rejection (f). These parameters being defined respectively in the following equations:

$$PWR = J_B\times M_B\times S\times3600 = A\times(p_h - p_{XA3})\times M_B\times S\times3600$$

$$PR = \frac{J_B\times M_B\times S\times3600}{\frac{1000}{1000+m_3\times M_A}}$$

$$m_3 = (1-f)\times m_1$$

where:

$m_1$ is molality of feed (moles of solute/1000 gram of water)

$m_3$ is molality of permeate solution (moles of solute/1000 gram of water)

$M_B$ is molecular weight of water (gram per mole)

$M_A$ is molecular weight of solute (gram per mole)

PWR is the pure water permeation rate (kg $h^{-1}$) and is determined for water with no dissolved or suspended solids PR is the product water rate (kg $h^{-1}$)

S is the membrane area ($m^2$) and the other parameters are as defined above.

The pure water permeation rate can be determined experimentally. Generally the pure water permeation rate (PWP) is 1 to 50% greater than the permeate rate (PR), depending on the solute concentration in the feed.

Using the above equations (herein referred to as the "Sourirajan Solution Diffusion model"), the three important coefficients, A, $D_{AM}K_A/\delta$, and k can be readily determined.

Preferably, the solute transport parameter ($D_{AM}K_A/\delta$) is within the range $0.5\times10^{-7}$ to $50\times10^{-7}$ $ms^{-1}$ as this is predicted to result in a permeate salt (total dissolved solids) concentration within the range of 500 to 5,000 ppm for a saline source water having a total dissolved solids content of 35,000 ppm.

Desirably, the water recovery is at least 40% by volume, i.e. at least 40% of the total volume of the source water passes through the membrane. Preferably, the recovery is at least 50% by volume, more preferably at least 60%, and especially up to 70% or 75% by volume.

A preferred process comprises reducing the salinity of a saline source water which has a total dissolved solids content of at least 17,500 ppm, by reverse osmosis at an applied pressure within the range 45 to 90 bar (4.5 to 9.0 MPa) to produce a treated water having a total dissolved solids content within the range 500 to 5000 ppm.

Owing to the relatively high salinity of the saline source water (a total dissolved solids content of at least 17,500 ppm), a relatively high pressure is required to be applied across the membrane to overcome the osmotic pressure across the membrane (and thereby drive the reverse osmosis). When a saline source water is subjected to a treatment in a plurality of reverse osmosis units arranged in series (where each reverse osmosis unit has a reverse osmosis membrane), the feed to the second and subsequent units in the series is the retentate from the preceding unit in the series. Accordingly, the feed stream to the final reverse osmosis unit of the series is of higher total dissolved solids content than the feed to the first unit in the series. Thus, the applied pressure across the membrane of the first and subsequent units in the series must be greater than the osmotic pressure across the membrane of the final unit in the series. Suitably, the applied pressure across the membrane of each reverse osmosis unit in the series is at least 0.1 MPa (1 bar) greater, preferably, at least 0.5 MPa (5 bar) greater than the osmotic pressure across the membrane of the final unit in the series. For example, where the source water has an initial total dissolved solids content of 35,000 ppm (0.6 molal), the osmotic pressure difference across the membrane of the first unit will be about 3 MPa (30 bar). Where the reverse osmosis units are arranged in series to achieve a water recovery of about 50%, the osmotic pressure difference across the membrane of the final unit in the series would be expected to be about 4.5 MPa (45 bar). Thus, an operating pressure over the series of reverse osmosis units of at least 4.6 MPa (46 bar), preferably, at least 5 MPa (50 bar), for example around 6 MPa (60 bar) would be required.

If the reduction in salinity is achieved in a multi stage desalination plant comprising a plurality of reverse osmosis units arranged in series, the applied pressure across at least one of the selectively permeable membranes of the units is usually at least 45 bar (4.5 M Pa) preferably at least 60 bar (6 MPa). If desired the origin of the source water being pumped at an applied pressure of at least 45 bar (4.5 MPa) to the membranes e.g. the first membrane of a series may be a retentate from an upstream desalination operation e.g. an earlier reverse osmosis operation on a source water of lower TDS content, such as seawater. This overall operation can comprise a low pressure reverse osmosis operation on seawater at an applied pressure of less than 45 bar (4.5 MPa) such as 20-45 bar (2.0-4.5 MPa) to produce a permeate which is then pumped independently at a higher applied pressure of at least 45 bar (4.5 MPa) to the or the first membrane.

Both reverse osmosis membranes and nanofiltration membranes may be used in the process of the present invention provided that they exhibit the required ranges of the proportionality constant, solute transport parameter and diffusivity of solute per unit length of the boundary layer. As discussed above, reverse osmosis membranes are relatively impermeable to all ions, including sodium and chlorine ions. On the other hand, nanofiltration membranes are usually more specific for the rejection of ions and are generally used to preferentially reject divalent ions, including magnesium, calcium, sulfate and carbonate ions. When compared with reverse osmosis membranes operating at comparable pressures, nanofiltration membranes usually have higher fluxes, i.e. the flow rate per unit area at which the solvent passes through the membrane.

Both reverse osmosis membranes and nanofiltration membranes typically comprise a relatively thin permselective discriminating layer, a porous support layer and a backing layer with the porous support layer sandwiched between the discriminating layer and backing layer. The porous support layer provides physical strength but offers little resistance to flow. The permselective discriminating layer determines the membrane's "salt rejection", i.e. the percentage of the dissolved solids (solute) that is rejected, and the flux under the chosen operating conditions.

Reverse osmosis membranes can be divided into two categories (1) asymmetric membranes prepared from a single polymeric material and (2) thin-film composite membranes prepared from a first and a second polymeric material. Asymmetric membranes have a dense polymeric discriminating layer supported on a porous support formed from the same polymeric material. Examples include asymmetric cellulose acetate membranes. Thin-film composite membranes comprise a permselective discriminating layer formed from a first polymeric material anchored onto a porous support material formed from a second polymeric material. Generally the permselective discriminating layer is comprised of a cross-linked polymeric material, for example, a cross-linked aromatic polyamide. Suitably, the porous support material is comprised of a polysulfone. Polyamide thin-film composite membranes are more commonly used in reverse osmosis desalination plants since they typically have higher water fluxes, salt and organic rejections and can withstand higher temperatures and larger pH variations than asymmetric cellulose acetate membranes. The polyamide thin-film composite membranes are also less susceptible to biological attack and compaction.

Nanofiltration membranes are generally comprised of charged polymeric materials (for example, having carboxylic acids or sulfonic acid functional groups) and as a result ion repulsion is a major factor in determining salt rejection. In the case of a negatively charged nanofiltration membrane, more highly charged anions such as sulfate ($SO_4^{2-}$) are more likely to be rejected by the permselective discriminating layer than monovalent anions such as chloride ($Cl^-$). Accordingly, use of a negatively charged nanofiltration membrane has the advantage of selectively reducing the amount of sulfate anions to below 40 ppm thereby reducing the amount of precipitate precursor ions in the injection water. A further advantage of nanofiltration membranes is that they typically have relatively high water fluxes at lower pressures than other reverse osmosis membranes.

Preferably, the membranes are "loose" reverse osmosis membranes of the type typically used for desalinating brackish water or "tight" nanofiltration membranes having a salt rejection of, for example, 85 to 99%, under brackish water desalination conditions. However, the membrane is operated at a higher pressure than employed for desalinating brackish water owing to the higher osmotic pressure associated with using a higher salinity source water. Thus, the upper pressure that is applied across a membrane during desalination of brackish water is generally 41 bar (4.1 MPa) while the pressure applied across the membrane in the process of the present invention is in the range 45 to 90 bar (4.5 to 9.0 MPa) (with the proviso that the applied pressure across the membrane is greater than the osmotic pressure across the membrane). Suitable "loose" reverse osmosis membranes are supplied by Dow Liquid Separations (Filmtec™ XLE-440, BW30LE-440) and GE Osmonics (Desal™ S Series SE). Suitable "tight" nanofiltration membranes are supplied by Dow Liquid Separations (Filmtec™ NF90-400). If necessary, the porous supporting layer and/or the backing layer of the membrane may be modified so that the membrane is capable of withstanding the higher applied pressures employed in the desalination step of the method of the present invention.

The membrane for use in the reverse osmosis units of the desalination plant is usually in the form of either a hollow fibre or spiral wound membrane module. A spiral-wound module consists of at least one membrane leaf and at least one feed spacer that are wound around a perforated permeate collection tube. Typically, the membrane leaf comprises a permeate spacer sandwiched between two membrane sheets and three edges of the membrane sheets are sealed, for example, with an epoxy resin, to form a membrane envelope, the open end of which is connected, longitudinally, to the perforated collection tube. The membrane leaf so produced is then wound spirally around the perforated collection tube together with the feed spacer. Generally, a plurality of membrane leaves are connected, longitudinally, to the perforated collection tube with feed spacers arranged between each membrane leaf, for example 2 to 6 leaves for a module of 4 inch (10.2 cm) diameter or 4 to 30 leaves for a module of 8 inch (20.3 cm) diameter. The membrane leaves and feed spacers are then wound spirally to form the module. The feed (saline source water) is channelled around the outside of the membrane envelopes and the module is operated with pressure on the outside of the membrane envelopes such that product water is forced into the interior of the membrane envelopes, and is collected in the perforated collection tube. The person skilled in the art would understand how to make a spiral wound module capable of withstanding the relatively high operating pressures employed in the process of the present invention. Thus, the pressure rating may be increased by any one of the following: increasing the thickness of the feed spacer (generally a polypropylene or polyethylene mesh having a thickness in the range 0.7 to 2.3 mm); increasing the thickness of the permeate spacer (generally a polyester woven cloth having a thickness of 0.2 to 1.0 mm); reinforcing the permeate spacer by coating with, for example, resins to provide structural strength; increasing the mechanical resistance of the membrane to compaction under pressure; and increasing the strength of the seals of the membrane envelope, for example, the strength of the epoxy glue.

Hollow-fibre modules consist of a plurality of elongate hollow or tubular fibres of a suitable membrane material, longitudinally aligned within a pressure vessel. The feed may flow along the outside of the fibres and permeate radially inwardly through the membrane material into the hollow interior of the fibres. Alternatively, the feed may flow through the hollow interior of the fibres and permeate radially outwardly through the membrane material. These modules have an extremely high packing density and hence can provide higher permeate rate per unit volume than spiral wound modules. The pressure rating of hollow fibre modules may be increased by decreasing the internal diameter of the fibres or by increasing their wall thickness.

Owing to their high packing density, hollow fibre modules are more prone to fouling than spiral wound modules. Thus, higher amounts of suspended solids in the feed water are less likely to be tolerated by hollow fibre modules because of the risk of fouling. A common measure used for suspended solids in reverse osmosis applications is the silt density index (SDI) defined by DuPont. The SDI is derived from the rate of plugging of a 0.45 micron filter paper run at 30 psig (0.3 MPa) applied pressure. The SDI test is disclosed in the ASTM D4189-95 (2002) Standard Test Method for Silt Density Index (SDI) of Water. Often it is recommended that the SDI should be less than 3 for hollow fibre modules, whereas spiral wound modules may be able to tolerate an SDI value of 5. Spiral wound modules are generally preferred over hollow fibre modules due to their superior salt rejection, energy efficiency, ease of operation and resistance to fouling.

As discussed above, the saline source water may be fed to a plurality of reverse osmosis units of the desalination plant arranged in series, preferably 2 to 5 reverse osmosis units, wherein the retentate from each successive unit in the series is of higher total salinity (total dissolved solids content) than the retentate from the preceding unit in the series and wherein the permeates from each of the reverse osmosis units of the series are combined to give a product stream of the desired total salinity (hereinafter "multi-stage desalination plant"). Thus, the permeate from the preceding unit in the series is used as feed to the succeeding unit in the series resulting in the permeate from each successive unit in the series being of higher total salinity that the permeate from the preceding unit of the series. An advantage of the method of the present invention for recovering hydrocarbons from a porous subterranean formation is that there is no requirement to reduce the total dissolved solids concentration of the injection water to the low levels required for high quality waters such as potable water. Where the low salinity treated water is obtained from a multi-stage desalination plant, the flux through the membranes of the reverse osmosis units may be higher than for a multistage desalination plant that produces high quality potable water. Preferably, the flux through each of the membranes of the multi-stage desalination plant is in the range 100-400 $l/m^2/h$ (where "flux" is defined as the volume of permeate passing through 1 $m^2$ of membrane per hour). Preferably, the water recovery (flow rate of the combined permeate stream) is up to 75% of the flow rate of the relatively high salinity source water that is fed to the first reverse osmosis unit of the series.

The relatively high salinity source water may also be fed to a single reverse osmosis unit (hereinafter "single stage desalination plant") wherein the flux of permeate through the membrane of the unit is selected so as to achieve the desired total salinity for the low salinity treated water. Preferably, a plurality of single reverse osmosis units are arranged in parallel. Where the low salinity treated water product stream is obtained in a single stage desalination plant, the flux of permeate through the membrane of the reverse osmosis unit may be higher than for a single stage desalination plant that produces high quality water, for example, potable water. Preferably, the flux of permeate passing through the membrane of the reverse osmosis unit is in the range 100-400 $l/m^2/h$. Typically, the flow rate of the permeate stream (the low salinity injection water product stream) is at least 40%, preferably, at least 50%, for example, up to 75% of the flow rate of the high salinity water feed stream.

If desired the reduction in salinity may be performed in more than one pass e.g. 2-4 passes, the permeate from the first pass being treated further to reduce its salinity in second (and subsequent) passes if any.

Preferably, the membrane module of the reverse osmosis unit is located within a pressurized housing. Preferably, the reverse osmosis unit(s) is provided with a cleaning system for removing fouling deposits from the surface of the membrane. Thus, the membrane module may be back-flushed with a portion of the low salinity water product stream (permeate). For example, a portion of the permeate may be passed to a tank of the cleaning system. Water from the tank is then periodically back-flushed through the membrane module before being recycled to the tank. A fine filter located in the cleaning system circuit removes fouling materials from the cleaning water. The water in the cleaning system tank may be periodically emptied and replaced by fresh permeate. Alternatively, during operation of the cleaning system, a portion of the cleaning water may be continuously discharged to the environment and fresh permeate may be continuously added to the cleaning water. Preferably, the membrane module is back-flushed with a dilute sodium hydroxide solution and optionally a dilute sodium bisulphate solution prior to being back-flushed with the permeate.

Typically, the saline source water is fed to the reverse osmosis unit(s) at a pressure in the range 4.5 to 9.0 MPa absolute (45 to 90 bar absolute), for example, 6.0 to 8.0 MPa absolute (60 to 80 bar absolute) with the proviso that the pressure is at least 0.1 MPa (1 bar) greater, preferably 0.5 MPa (5 bar) greater, for example, 1.5 MPa (15 bar) greater than the osmotic pressure. The treated water typically leaves the reverse osmosis unit at a pressure of about 0.1 MPa (1 bar absolute). Preferably, the energy associated with the pressurized waste brine stream (retentate) may be recovered, for example, using a device such as a Pelton Wheel, that is coupled to the rotor of a pump, or a Dual work energy exchanger, or a pressure exchanger.

Weight and space are often not significant constraints for the known equipment for desalination of water, which are often used at onshore locations. However, the water for waterflooding is often injected from an offshore platform where weight and space requirements are major design factors. There is therefore a need for a relatively small, relatively light desalination plant. Suitably, the plant has a footprint of less than 2 $m^2$ per mbwpd of treated water product where mbwpd is 1000 barrels of treated water product per day (0.0126 $m^2$ per $m^3$ of treated water product). Suitably, the plant has a mass of less than 3 tonnes (operating) per mbwpd of treated water product (0.019 tonnes per $m^3$ of treated water product). Alternatively, the plant may be submerged in a body of water, as described in WO2005/119007.

The treated water usually has a total dissolved solids (TDS) content of 500 to 5000 ppm, preferably 500 to 3000 ppm or 750-2000 ppm, and is usually made at this total dissolved solids content directly by the reverse osmosis.

If the TDS level of the permeate produced by the reverse osmosis is not optimum for the formation into which it is to be injected, then the process parameters, e.g. pressure or degree of recovery or ultimately membrane or number of steps, can be changed, or the level can be adjusted, especially when it is already in the 500-5000 ppm TDS region, by addition of an aqueous liquid of different TDS level. This aqueous liquid may have a higher TDS level, as with saline source water such as sea water or retentate, or a lower level such as purified water. Preferably, and especially to compensate for minor operational variations in continuous operations, any such adjustment is controlled automatically by analysis of the permeate, for example by measuring its conductivity, and feedback control by adding the requisite amount of aqueous liquid. If desired aqueous liquids of higher and lower TDS levels may be made available for the continuous control of the TDS level up or down. If necessary after any adjustment and before injection into the formation, purification of the product liquid produced can be performed to reduce the risk of mineral scale precipitation in the formation.

The waste brine stream (retentate) outlet of the reverse osmosis desalination plant is preferably located at a distance from the relatively high salinity source water feed inlet thereby mitigating the risk of the waste brine being recycled to the desalination plant.

Preferably the saline source water undergoes pre-treatment before being fed to the reverse osmosis unit. Some pre-treatments extend the lifetime of the membranes such as dechlorination for aromatic polyamide thin-film membranes (by adsorption of chlorine on activated carbon or by addition of sodium bisulfite to the saline source water feed) or pH adjustment of the saline source water to prevent hydrolysis of asymmetric cellulose acetate membranes. Particularly useful pretreatments are those designed to reduce fouling of the reverse osmosis membrane. These may include, adjusting the pH of the saline source water or adding scale inhibitors to the saline source water to reduce membrane scaling; deoxygenating the saline source water to reduce metal oxide fouling; mechanical filtration of the saline source water to remove particles that are too large to pass easily through the feed channels of the membrane module and therefore could potentially become trapped in the membrane module; addition of coagulants to the saline source water followed by sedimentation and filtration to reduce colloidal fouling; or the addition of a biocide to the saline source water to reduce biological fouling.

Preferably, the process of the present invention results in an increase in hydrocarbon recovery from the hydrocarbon-bearing formation of at least 5%, for example in the range 5 to 20% when compared with a waterflood treatment using the untreated high salinity source water.

The present invention will now be illustrated by reference to FIG. 1 and the Examples.

EXPERIMENTAL

Apparatus

The apparatus employed to determine the suitability of membranes for use in the desalination process of the present invention is illustrated in FIG. 1.

The apparatus comprises a vessel (1) fitted with a stirrer (2), and a housing (3) that is divided into a first chamber (4) and a second chamber (5) by a flat sheet membrane (6) that is sealed in an O-ring (7). A saline source water flow line (8) is in fluid communication with the vessel (1) and the first chamber (4) of the housing (3). A high pressure pump (9) is located in the flow line (8) and a pressure gauge (10) is positioned downstream of the high pressure pump (9). A retentate flow line (11) is in fluid communication with the first chamber (4) of the housing (3) and the vessel (1). A permeate flow line (12) having a low pressure circulation pump (13) located therein, is in fluid communication with the second chamber (5) of the housing (3) and the vessel (1). In use, a model saline source water is introduced into the vessel (1) and is fed via the saline source water flow line (8) and high pressure pump (9) to the first chamber (4) of the housing (3) at a pressure in the range of 45 to 90 bar (4.5 to 9 MPa), typically 60 bar (6 MPa) with the pressure adjusted by means of valve (14) positioned in the retentate flow line (11). A permeate stream is returned to the vessel (1) via the permeate flow line (12) and the low pressure circulation pump (13). A retentate stream is returned to the vessel (1) via the retentate flow line (11). Stirrer (2) ensures that the permeate and retentate streams are mixed with the saline source water in the vessel (1) so that the saline source water feed to the first chamber (4) of the housing (3) is of uniform composition. Typically, the test is carried out at ambient temperature, for example, at a temperature of 10 to 30° C. The retentate and permeate streams are returned to vessel (1) until steady state conditions are reached. The permeate and retentate streams are then analysed to determine their total dissolved solids content.

Example 1

A flat sheet FILMTEC™ NF90-400 nanofiltration membrane (1 $m^2$ area) was tested using the above apparatus. "The membrane had the following properties:

a) a proportionality constant (A) of $1.2\times10^{-6}$ kmol $m^{-2}s^{-1}kPa^{-1}$, b) a solute transport parameter ($D_{AM}K_A/\delta$) of $0.853\times10^{-7}$ $ms^{-1}$, and c) a diffusivity of solute per unit length of the boundary layer (k) of $2.85\times10^{-5}$ $ms^{-1}$."The high salinity water feed stream to the first chamber of the housing had a sodium chloride concentration of 35,000 ppm. The applied pressure across the membrane was 60 bar (6 MPa) and the temperature was 25° C. It was found that the permeate stream had a total dissolved solids content of about 2500 ppm when steady state conditions were reached. Thus, the permeate stream has the desired total dissolved solids content.

The permeate stream may be injected into a hydrocarbon-bearing formation via an injection well, the permeate water displacing hydrocarbons towards a production well, from which the displaced hydrocarbons may be recovered from the formation.

Comparative Example 1

A flat sheet FILMTEC™ NF90-400 nanofiltration membrane (1 $m^2$ area) was tested using the above apparatus under typical brackish water conditions. Thus, brackish water having a total dissolved solids content of 4000 ppm (2000 ppm NaCl and 2000 ppm $MgSO_4$) was fed to the first chamber of the housing. The applied pressure across the membrane was 0.48 MPa (4.8 bar) and the temperature was 25° C. The permeate stream was found to have a total dissolved solids content of less than 500 ppm (100-300 ppm NaCl and less than 60 ppm $MgSO_4$). Thus, the total dissolved solids content of the permeate stream was lower than required for the treated water that is used in the process of the present invention.

The invention claimed is:

1. A method of recovering hydrocarbons from a porous subterranean hydrocarbon bearing formation comprising:

(a) reducing the salinity of a saline source water by reverse osmosis using a membrane having a first surface and a second surface by (i) feeding the saline source water to the first surface of the membrane, and (ii) removing treated water of reduced salinity from the second surface of the membrane; and (b) injecting the treated water into the formation;

wherein the membrane is selectively permeable to water over dissolved solids such that when (i) the saline source water has a total dissolved solids content of at least 17,500 ppm, and (ii) the applied pressure across the membrane is greater than the osmotic pressure across the membrane and lies within the range 45 to 90 bar (4.5 to 9.0 M Pa), the total dissolved solids content of the treated water is in the range 500 to 5000 ppm.

2. A method according to claim 1 wherein the salinity of a saline source water which has a total dissolved solids content of at least 17,500 ppm, is reduced by reverse osmosis at an applied pressure within the range 45 to 90 bar (4.5 to 9.0 M Pa) to produce a treated water having a total dissolved solids content within the range 500 to 5000 ppm.

3. A method according to claim 1 wherein the selectively permeable membrane is determined to have:

(a) a proportionality constant (A) of from $0.01\times10^{-6}$ to $10-10^{-6}$ kmol $m^{-2}s^{-1}kPa^{-1}$, (b) a solute transport parameter ($D_{AM}K_A/\delta$) of from $0.5\times10^{-7}$ to $50\times10^{-7}$ $ms^{-l}$, (c) a diffusivity of solute per unit length of the boundary layer (k) of from $0.1\times10^{-5}$ to $10\times10^{-5}$ $ms^{-1}$, when the performance of the membrane in the applied pressure range of 4.5 to 9.0 M Pa is described using the Sourirajan Diffusion model.

4. A method according to claim 1 in which the selectively permeable membrane is arranged in a reverse osmosis unit of a desalination plant.

5. A method according to claim 4 wherein the desalination plant comprises a plurality of reverse osmosis units arranged in series wherein the applied pressure across at least one of the selectively permeable membranes of the reverse osmosis units is at least 60 bar (6 M Pa).

6. A method according to claim 1 wherein at least 40% of the volume of the saline source water is recovered as treated water.

7. A method according to claim 1 wherein the hydrocarbons are recovered from the porous hydrocarbon-bearing formation by injecting at least a portion of the treated water into the hydrocarbon-bearing formation via an injection well, displacing hydrocarbons with the treated water towards a production well, and recovering the displaced hydrocarbons from the formation via the production well.

* * * * *